US012168909B1

(12) United States Patent
Sui et al.

(10) Patent No.: US 12,168,909 B1
(45) Date of Patent: Dec. 17, 2024

(54) RECOVERY TOOL AND METHOD FOR TUBING HANGER

(71) Applicant: WEFIC Ocean Equipment Manufacturing co., Ltd., Dongying (CN)

(72) Inventors: Zhongfei Sui, Dongying (CN); Huaguo Liu, Dongying (CN); Xiaotao Yu, Dongying (CN); Juliang Ge, Dongying (CN); Wuhai Wang, Dongying (CN); Xiaoxiao Guo, Dongying (CN); Xu Chen, Dongying (CN)

(73) Assignee: WEFIC Ocean Equipment Manufacturing co., Ltd., Dongying (CN)

( * ) Notice: Subject to any disclaimer, the term of this patent is extended or adjusted under 35 U.S.C. 154(b) by 0 days.

(21) Appl. No.: 18/672,026

(22) Filed: May 23, 2024

(30) Foreign Application Priority Data

Dec. 19, 2023 (CN) ..... 202311746762.1

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

2011/0226490 A1* 9/2011 Nguyen ..... E21B 33/04 166/382
2016/0186523 A1* 6/2016 Nguyen ..... E21B 33/0422 166/77.51

FOREIGN PATENT DOCUMENTS

CN 110017109 A 7/2019
CN 217538641 U 10/2022
CN 116658101 A 8/2023

* cited by examiner

*Primary Examiner* — Dany E Akakpo
(74) *Attorney, Agent, or Firm* — Bayramoglu Law Offices LLC

(57) ABSTRACT

A tubing hanger recovery tool and a recovery method are provided. The tubing hanger recovery tool includes a mandrel, a locking part and a hook claw part; a lower end face of the mandrel is in contact with an inner side of the locking part, and when the mandrel moves towards the tubing hanger, the locking part is squeezed and locked with the tubing hanger; the hook claw part surrounds the mandrel, and when the mandrel moves towards the tubing hanger, it drives the hook claw part to move towards the tubing hanger, and the hook claw part is clamped with the setting ring of the tubing hanger.

4 Claims, 7 Drawing Sheets

RECOVERY TOOL AND METHOD FOR TUBING HANGER

CROSS REFERENCE TO THE RELATED APPLICATIONS

This application is based upon and claims priority to Chinese Patent Application No. 202311746762.1, filed on Dec. 19, 2023, the entire contents of which are incorporated herein by reference.

TECHNICAL FIELD

The disclosure relates to the technical field of petroleum exploitation, in particular to a recovery tool and a recovery method for tubing hanger.

BACKGROUND

Tubing hanger is one of the key equipment for underwater wellhead oil production. When the tubing hanger being used, it needs to be placed in deep water. However, the marine environment is diverse, and the regional environment for oil exploitation will be more complicated, such as waves, ocean currents, drifting of drilling ships, circulating internal pressure, etc., so the recovery of tubing hanger becomes particularly complicated.

In the prior art, the equipment used for recovering the tubing hanger has poor safety, so there is an urgent need for a more robust tubing hanger recovery tool.

SUMMARY

The disclosure provides a recovery tool and a recovery method for tubing hanger, which are used for solving the defect of poor safety of equipment used for recovering the tubing hanger in the prior art. The tubing hanger can be doubly locked through a locking part and a hook claw part, and the recovery safety of the tubing hanger can be improved through the cooperation of the locking part and the hook claw part.

The disclosure provides a tubing hanger recovery tool, wherein comprising: a mandrel, a locking part and a hook claw part;

a lower end face of the mandrel is in contact with an inner side of the locking part, and the mandrel squeezes the locking part when moving to the tubing hanger, and the locking part is locked with the tubing hanger after being squeezed;

the hook claw part surrounds the mandrel, and the mandrel drives the hook claw part to the tubing hanger when moving to the tubing hanger, and the hook claw part is clamped with a setting ring of the tubing hanger.

According to the tubing hanger recovery tool provided by the disclosure, wherein both sides of a bottom end of the mandrel are inverted trapezoidal surfaces, the inner side of the locking part is a regular trapezoidal surface, and the inclined surface of the bottom end of the mandrel is in contact with the inclined surface of the locking part.

According to the tubing hanger recovery tool provided by the disclosure, wherein the locking part comprises a locking block and a locking ring;

the locking block has a right-angled trapezoidal structure, and an inclined waist of the locking block is in contact with the inclined surface of the bottom end of the mandrel;

a right-angled waist of the locking block is connected with the locking ring;

when the mandrel moves to the tubing hanger, it pushes the locking block and the locking ring, and the locking ring locks the tubing hanger.

According to the tubing hanger recovery tool provided by the disclosure, wherein the hook claw part comprises a hook claw connector and a plurality of hook claws, and the hook claws are clamped with the setting ring of the tubing hanger;

the tops of a plurality of hook claws are connected with the hook claw connector, the hook claws surround the mandrel, and the bottoms of the hook claws are barbs distributed inward.

According to the tubing hanger recovery tool provided by the disclosure, wherein the hook claw part is connected with the mandrel through a piston part;

the piston part comprises an expansion ring, which is arranged between the hook claw and the mandrel, and used for pushing the hook claw to expand outwards to separate the hook claw from the setting ring of the tubing hanger.

According to the tubing hanger recovery tool provided by the disclosure, wherein a bottom end of the expansion ring comprises a boss, and an inner side of the hook claw is provided with an expansion bulge, and the boss of the expansion ring pushes the hook claw to expand outwards by squeezing the expansion bulge.

The disclosure also provides a method for recovering tubing hanger, comprising:

moving the tubing hanger recovery tool directly above the tubing hanger;

moving the mandrel downwards for a first distance, the bottom end of the mandrel squeezes the locking part, and the locking part is locked with the tubing hanger, and the hook claw part is clamped with the setting ring of the tubing hanger;

moving the mandrel upwards for a second distance, and under the drive of the mandrel, the hook claw part moves upwards for the second distance together with the setting ring of the tubing hanger;

pulling the tubing hanger to move together by using the tubing hanger recovery tool to realize the recovery of the tubing hanger.

According to the method provided by the disclosure, wherein before pulling the tubing hanger to move together by using the tubing hanger recovery tool further comprises:

carrying out safety detection, and if determining the tubing hanger recovery tool can pull the tubing hanger, recovering the tubing hanger;

if determining the tubing hanger recovery tool cannot pull the tubing hanger, controlling the tubing hanger recovery tool to unlock the tubing hanger.

According to the method provided by the disclosure, wherein controlling the tubing hanger recovery tool to unlock the tubing hanger comprises:

moving the mandrel downwards for a third distance to unlock the hook claw part from the setting ring of the tubing hanger;

moving the mandrel upwards for a fourth distance to unlock the locking part from the tubing hanger.

According to the method provided by the disclosure, wherein moving the mandrel downwards for a third distance to unlock the hook claw part from the setting ring of the tubing hanger comprises:

moving the mandrel downwards for the third distance, and a bottom end of the hook claw part expands, thus unlocking the hook claw part from the setting ring of the tubing hanger.

When the tubing hanger in the deep sea is recovered by using the tubing hanger recovery tool and method provided by the disclosure, the tubing hanger can be doubly locked between the locking part and the hook claw part, so that the fastness degree of the tubing hanger may be improved, and the recovery safety of the tubing hanger may be improved.

BRIEF DESCRIPTION OF THE DRAWINGS

In order to explain the technical solution of the present disclosure or the prior art more clearly, the drawings needed to be used in the description or the prior art will be briefly introduced below. Obviously, the drawings below are some embodiments of the present disclosure, and other drawings can be obtained according to these drawings without creative work for ordinary skills in the field.

AMONG THEM

1—mandrel; 2—locking block; 3—locking ring; 4—hook claw connector; 5—hook claw; 6—expansion ring; 7—boss; 8—piston retaining ring; 9—fitting screw; 10—S ring; 11—short head hexagon socket head screw; 12—O ring; 13—shear pin; 14—locking ring retaining ring; 15—piston.

DETAILED DESCRIPTION OF THE EMBODIMENTS

In order to make the purpose, technical solution and advantages of the present disclosure more clear, the technical solution of the present disclosure will be described clearly and completely with reference to the attached drawings. Obviously, the described embodiments are part of the embodiments of the present disclosure, but not all of them. Based on the embodiments in the present disclosure, all other embodiments obtained by ordinary skills in the field without creative work belong to the scope of protection of the present disclosure.

Figure 1:
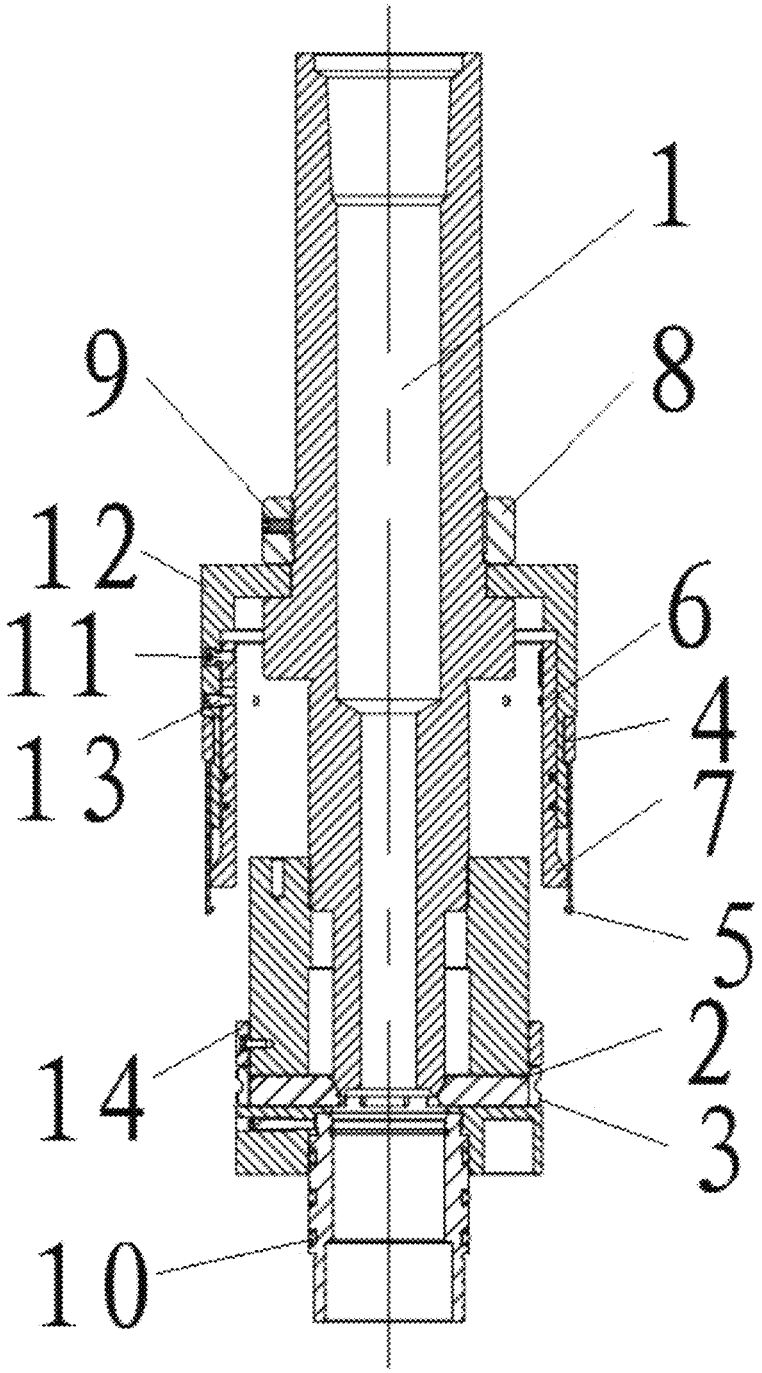
FIG. 1 is a first structural schematic diagram of tubing hanger recovery tool provided by the embodiment of the disclosure.

FIG. 1 is a first structural schematic diagram of tubing hanger recovery tool provided by the embodiment of the present disclosure.

As shown in FIG. 1, this embodiment provides a tubing hanger recovery tool, comprising:

A mandrel 1, a locking part and a hook claw part;

A lower end face of the mandrel 1 is in contact with an inner side of the locking part, and when the mandrel 1 moves to the tubing hanger, the locking part is squeezed and locked with the tubing hanger;

The hook claw part surrounds the mandrel, and when the mandrel moves towards the tubing hanger, it drives the hook claw part to move towards the tubing hanger, and the hook claw part is clamped with the setting ring of the tubing hanger.

In practice, the bottom of the recovery tooling is provided with a positioning key, which is blocky, and can facilitate the positioning and locking of the tubing hanger in the recovery process. In practical application, the positioning keys are symmetrically distributed on both sides of the recovery tool.

In practical application, the setting ring of tubing hanger is equivalent to the "hand brake" of tubing hanger. In the process of tubing hanger recovery, it is necessary to put down the "hand brake" of tubing hanger, so as to move tubing hanger smoothly and recover tubing hanger smoothly.

In this embodiment, after the mandrel rotates downwards to unlock the locking part, the locking part moves outwards and locks with the corresponding groove of the tubing hanger, so as to realize a primary locking of the recovery tool and the tubing hanger, and when the mandrel continues to be transported downwards to hook the setting ring of the tubing hanger, a secondary locking is realized, and the safety of the tubing hanger in the recovery process can be improved by setting two aspects of locking.

In an exemplary embodiment, both sides of the bottom end of the mandrel are inverted trapezoidal surfaces, the inner side of the locking part is a regular trapezoidal surface, and the inclined surface of the bottom end of the mandrel is in contact with the inclined surface of the locking part.

In an exemplary embodiment, the locking part comprises a locking block 2 and a locking ring 3;

The locking block 2 has a right-angled trapezoidal structure, and the inclined waist of the locking block 2 is in contact with the inclined surface at the bottom end of the mandrel 1;

The right-angled waist of the locking block 2 is connected with the locking ring 3;

When the mandrel 1 moves towards the tubing hanger, it pushes the locking block 2 and the locking ring 3, and the locking ring 3 locks the tubing hanger.

In practical application, the number of locking blocks can be four, which are evenly around the mandrel, that is, an included angle of 90 degrees is formed between two adjacent locking blocks.

The locking block can slide in the groove where it is located, specifically, it is pushed to slide when the mandrel moves downward.

In practice, the locking block has a right-angled trapezoidal structure, and the structure of the locking ring matches the corresponding groove position of the tubing hanger. When the mandrel does not move downwards, the locking ring is retracted in the recovery tool and does not contact with the tubing hanger. When the mandrel moves downwards to the locking block, the mandrel pushes the locking block to move outwards, thereby expanding the locking ring, and the locking ring pushed out by the locking block is locked with the corresponding groove of the tubing hanger.

In an exemplary embodiment, the excircles of the lower part and the middle and upper part of the locking block are conical surfaces inclined at a small angle.

In the exemplary embodiment, the hook claw part comprises a hook claw connector 4 and a plurality of hook claw 5, and the hook claw 5 is clamped with the setting ring of the tubing hanger;

The tops of the hook claws 5 are connected with the hook claw connector 4, the hook claws 5 surround the mandrel 1, and the bottoms of the hook claws 5 are barbs distributed inward.

In an exemplary embodiment, the hook claw part is connected with the mandrel through a piston part;

The piston part comprises an expansion ring 6, which is arranged between the hook claw and the mandrel, and is used for pushing the hook claw 5 to expand outwards to separate the hook 5 from the setting ring of the tubing hanger.

In practical application, the contact surface between the hook claw part and the piston parts is provided with a plurality of threaded holes, and the hook claw part can be firmly fixed on the piston part by using the threaded holes and bolts.

In an exemplary embodiment, the bottom of the expansion ring comprises a boss 7, and an inner side of the hook claw is provided with an expansion bulge, and the boss 7 of the expansion ring pushes the hook claw to expand outward by squeezing the expansion bulge.

In practical application, as shown in FIG. 1, the tubing hanger recovery tool provided by the disclosure further comprises a piston 12 and a piston retaining ring 8, wherein the piston is used for driving the expansion ring to move, and the piston retaining ring is used for fixing the piston 12; it also comprises a fitting screw 9, which is used to fix the piston retaining ring after tightening; it also comprises an S ring 10, which is equivalent to a sealing sleeve and plays a sealing role after being combined with other devices; it also comprises a short-headed hexagon socket head screw 11 for fixing the piston and the expansion ring, a shear pin 13 can be cut short when the piston and the expansion ring are displaced relative to each other, so that the expansion ring can squeeze the external hook claw to expand the hook claw outward, and a hexagon socket head screw 14 is used for limiting the movement of the locking ring.

Hereinafter, the tubing hanger recovery method provided by the present disclosure will be described, and the tubing hanger recovery method described below and the tubing hanger recovery method described above can refer to each other correspondingly.

Figure 2:
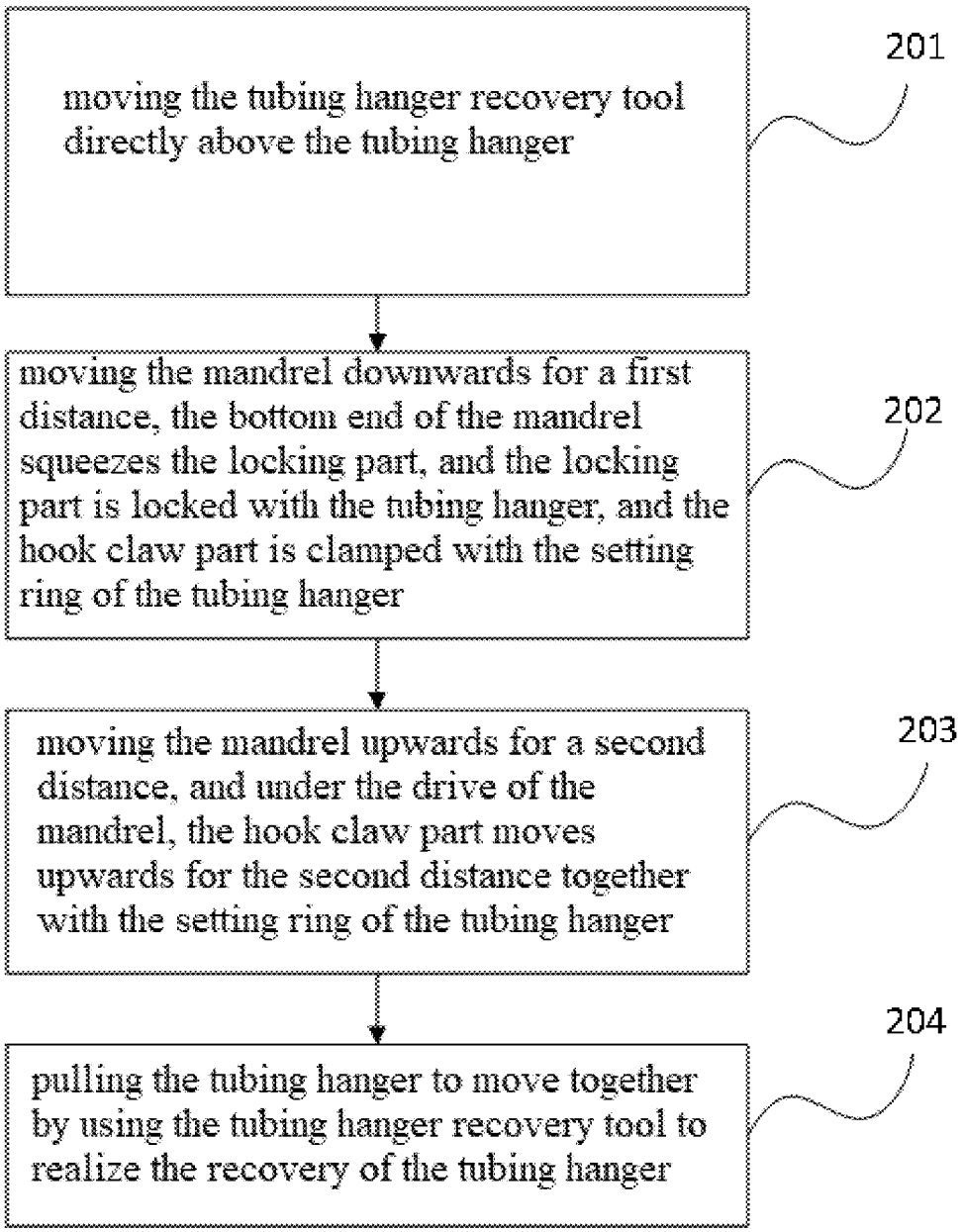
FIG. 2 is a schematic flow chart of the tubing hanger recovery method provided by the embodiment of the disclosure.

FIG. 2 is a schematic flow chart of the tubing hanger recovery method provided by the embodiment of the disclosure.

As shown in FIG. 2, the tubing hanger recovery method provided by the disclosure comprises:

Step 201, moving the tubing hanger recovery tool directly above the tubing hanger;

Step 202, moving the mandrel downwards for a first distance, the bottom end of the mandrel squeezes the locking part, and the locking part is locked with the tubing hanger, and the hook claw part is clamped with the setting ring of the tubing hanger;

Step 203, moving the mandrel upwards for a second distance, and under the drive of the mandrel, the hook claw part moves upwards for the second distance together with the setting ring of the tubing hanger;

In step 204, pulling the tubing hanger to move together by using the tubing hanger recovery tool to realize the recovery of the tubing hanger.

In the exemplary embodiment, before pulling the tubing hanger to move together by using the tubing hanger recovery tool, further comprising:

carrying out safety detection, and if determining the tubing hanger recovery tool can pull the tubing hanger, recovering the tubing hanger;

if determining the tubing hanger recovery tool cannot pull the tubing hanger, controlling the tubing hanger recovery tool to unlock the tubing hanger.

In an exemplary embodiment, controlling the tubing hanger recovery tool to unlock the tubing hanger comprises:

moving the mandrel downwards for a third distance to unlock the hook claw part from the setting ring of the tubing hanger;

moving the mandrel upwards for a fourth distance to unlock the locking part from the tubing hanger.

In an exemplary embodiment, moving the mandrel downwards for a third distance to unlock the hook claw part from the setting ring of the tubing hanger comprises:

moving the mandrel downwards for the third distance, and a bottom end of the hook claw part expands, thus unlocking the hook claw part from the setting ring of the tubing hanger.

In practical application, the fourth distance can be greater than the first distance, the first distance can be greater than the third distance, and the third distance can be greater than the second distance.

The specific implementation method of the tubing hanger recovery method provided in this embodiment can be implemented with reference to the above-mentioned embodiment, and will not be repeated here.

The following describes the tubing hanger recovery method provided by the disclosure with a specific embodiment in combination with the tubing hanger recovery tool provided by the application, comprising:

As shown in FIG. 1, it is a state that the tubing hanger recovery tool is not working. It can be seen that the lower end surface of the mandrel is a conical surface, which is in contact with the inner side of the locking part, and the locking part is not squeezed by the mandrel. In this state, the tubing hanger recovery tool is not locked with the tubing hanger.

Figure 3:
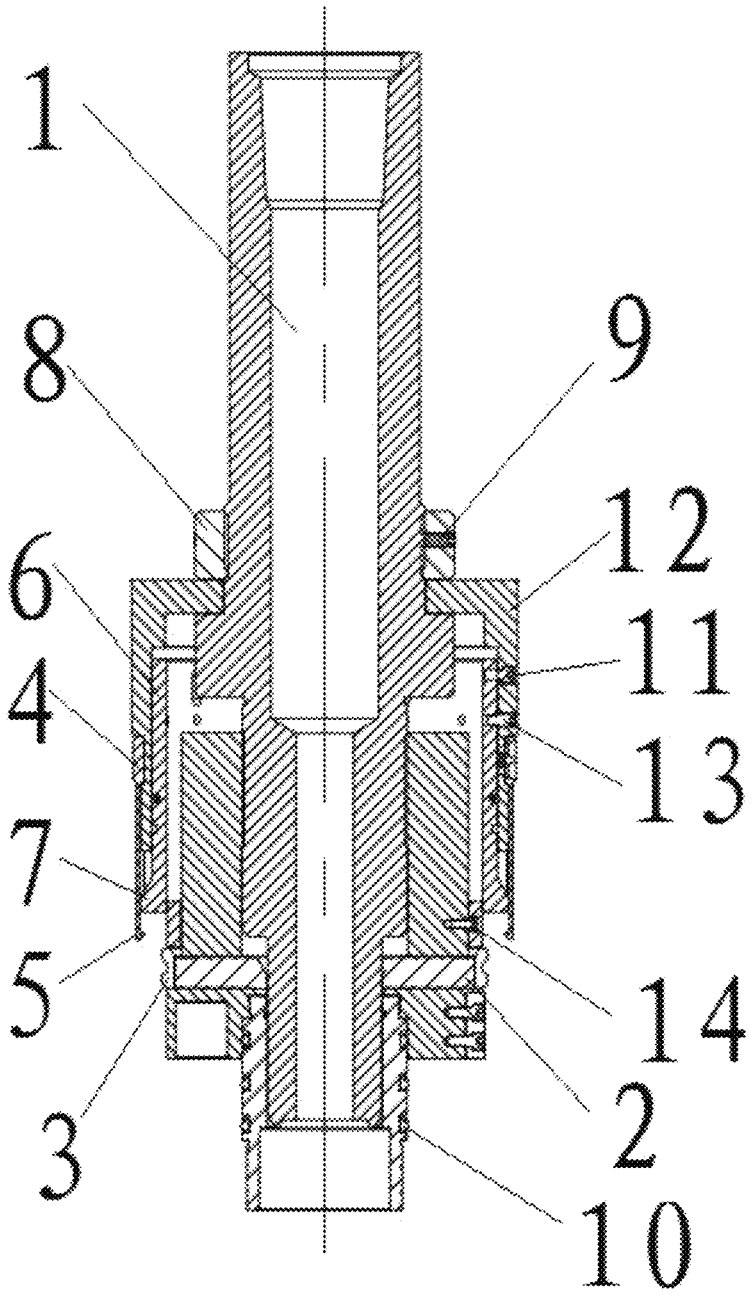
FIG. 3 is a second structural schematic diagram of tubing hanger recovery tool provided by the embodiment of the disclosure.

As shown in FIG. 3, it is a state that the mandrel of the tubing hanger recovery tool normally descends to the bottom. In this state, the lower end face of the mandrel squeezes the locking block in the locking part to the outside, and the locking block squeezes the locking ring on the outside to make the locking ring expand to the outside and lock with the corresponding groove of the tubing hanger to be recovered. At the same time, the mandrel drives the hook claw part to move downwards through the piston part, and the hook claw at the bottom of the hook claw part can be clamped with the setting ring of the tubing hanger after descending to the bottom. In this state, the tubing hanger recovery tool and the tubing hanger are locked.

Figure 4:
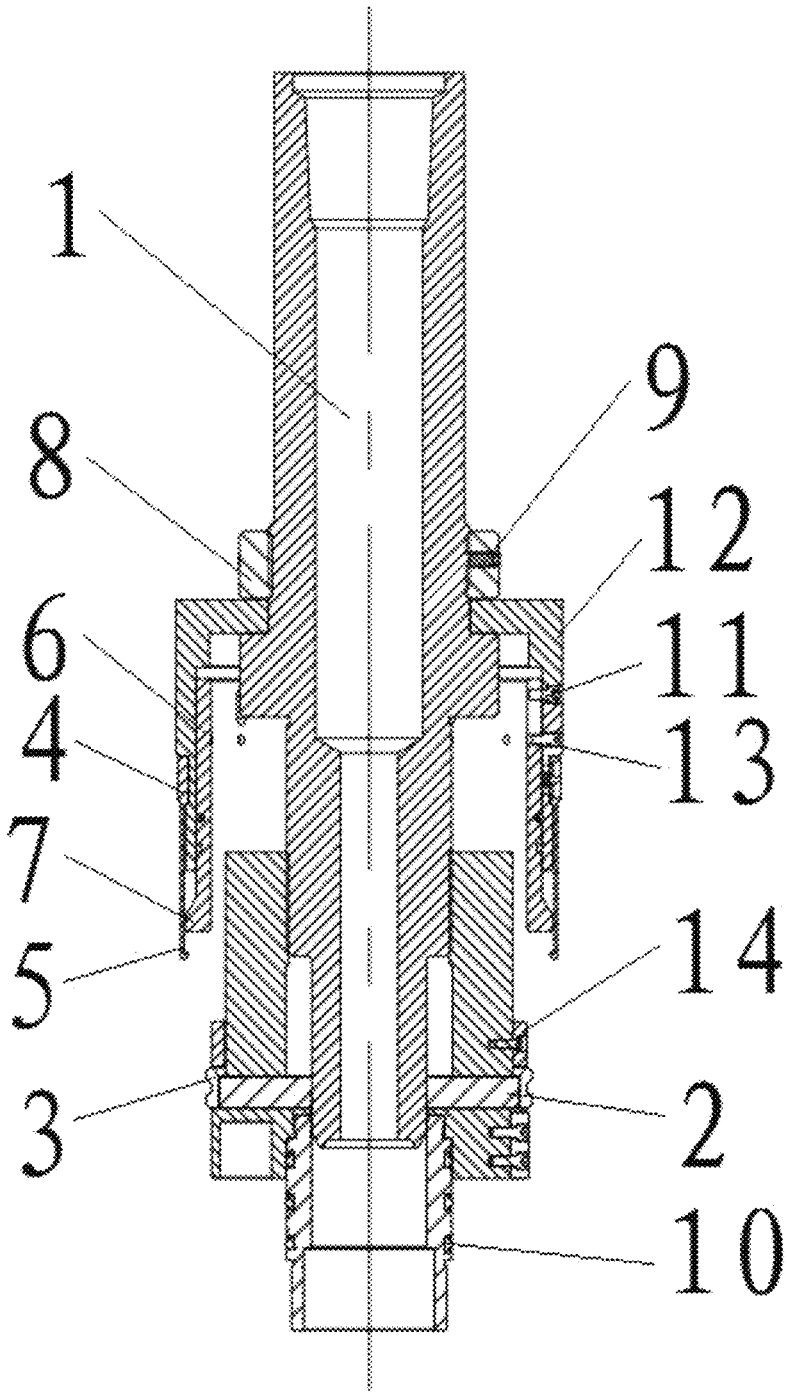
FIG. 4 is a third structural schematic diagram of tubing hanger recovery tool provided by the embodiment of the disclosure.

As shown in FIG. 4, it is a state that the mandrel of the tubing hanger recovery tool moves upward for a certain distance after descending to the bottom. According to FIG. 4, after the mandrel moves upward for a certain distance, the bottom of the mandrel is still at the bottom of the locking part, that is to say, the locking block and the locking ring are still pushed outward by the mandrel. The purpose of this step is to pull the setting ring of the tubing hanger upward for a certain distance, the setting ring of the tubing hanger is actually equivalent to the "hand brake" of the tubing hanger. This step is equivalent to releasing the "hand brake" of the tubing hanger, which is convenient for the subsequent recovery work. In this state, the tubing hanger recovery tool and tubing hanger are still locked.

Under normal conditions, after the mandrel moves upward for a certain distance, the locked tubing hanger can be driven to move together by moving the tubing hanger recovery tool, so as to realize the recovery of the tubing hanger. However, before moving the tubing hanger, it is necessary to carry out safety detection to test whether the tubing hanger recovery tool can successfully recover the tubing hanger at the bottom. If the test result determines that it cannot be successfully recovered, it is necessary to control the tubing hanger recovery tool to release the tubing hanger and replace other recovery tools.

Figure 5:
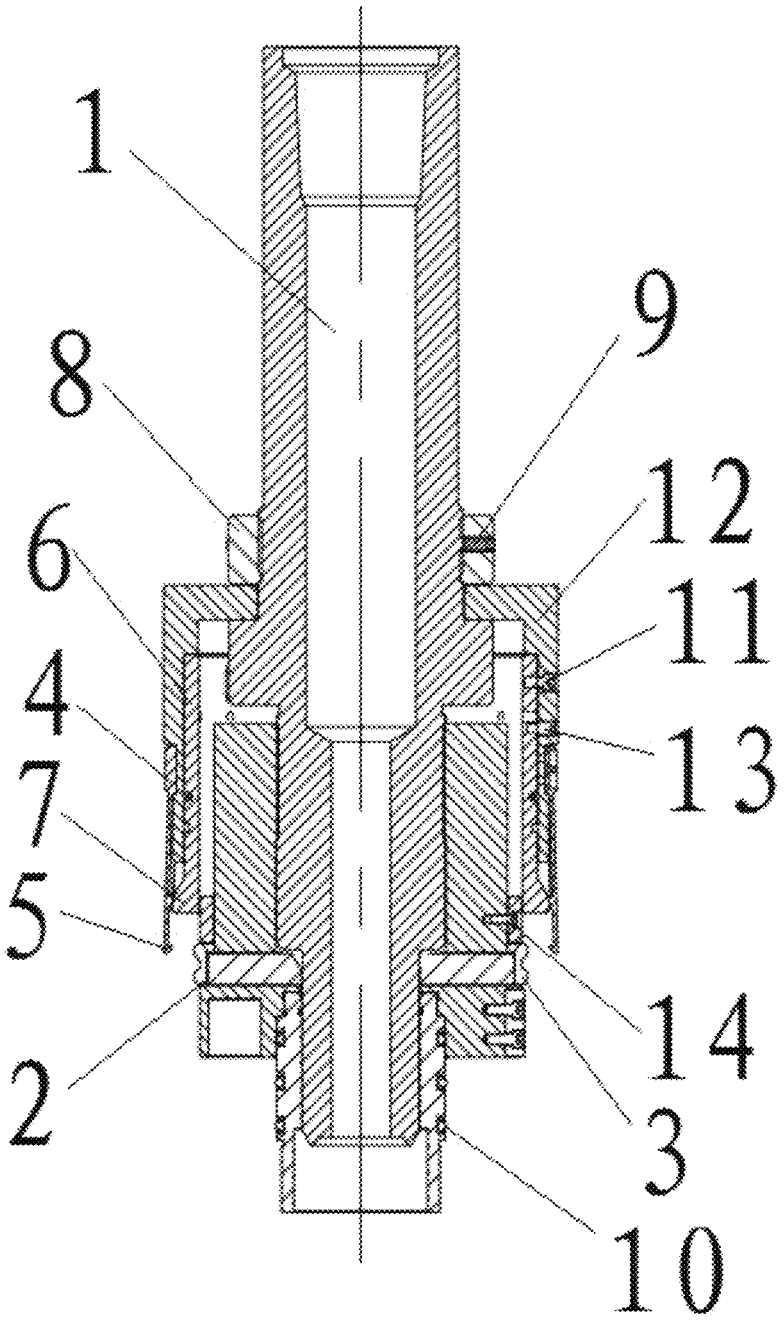
FIG. 5 is a fourth structural schematic diagram of tubing hanger recovery tool provided by the embodiment of the disclosure.

FIG. 5 is a schematic structural diagram when the tubing hanger recovery tool releases the tubing hanger. As shown in FIG. 5, in this state, it is necessary to control the mandrel to move downward again, and the moving distance is longer than the normal downward moving distance of the mandrel. As shown in FIG. 5, that is, the mandrel is moved to the first step of the mandrel, which is overlapped with the top surface of the locking block. In this state, the piston part can contact with the expansion ring, so that the expansion bulge inside the hook claw can be just clamped on the boss at the bottom of the expansion ring. Under the extrusion of the boss, the hook claws open outward, so that the setting ring of the tubing hanger at the bottom naturally falls back to its original position without the hook claws. Then, the mandrel can return to the initial position as shown in FIG. 1 by just moving the mandrel upward, then the tubing hanger recovery tool can be moved away and replaced with a new recovery tool to recover the tubing hanger.

Figure 6:
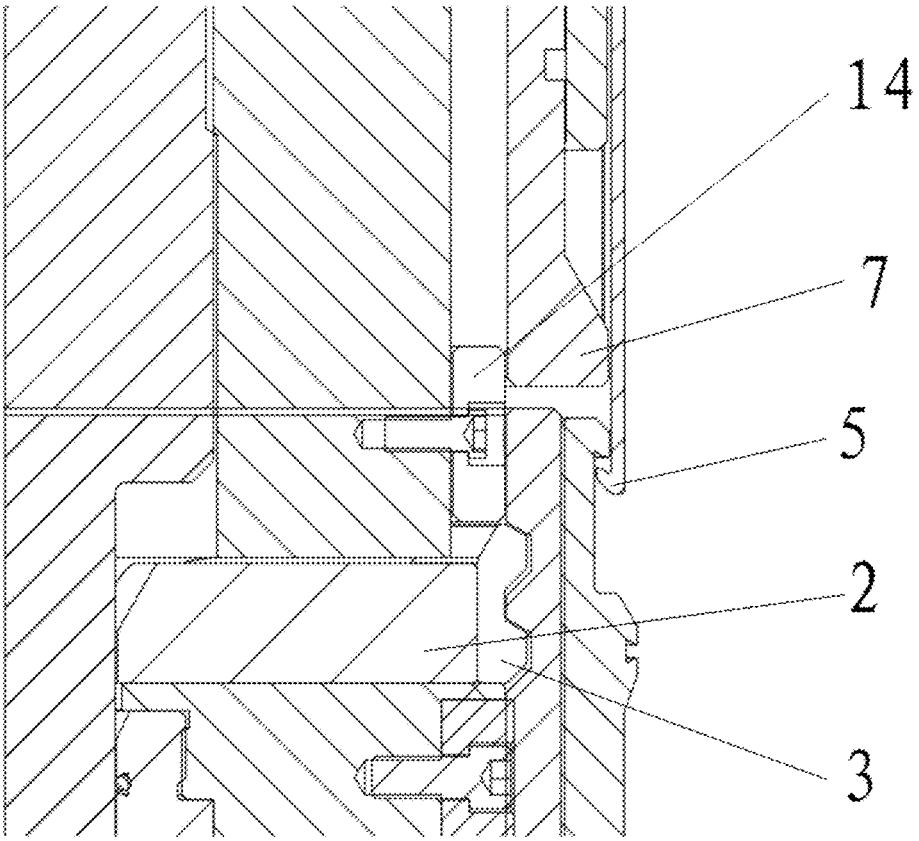
FIG. 6 is a fifth structural schematic diagram of tubing hanger recovery tool provided by the embodiment of the disclosure.
Figure 7:
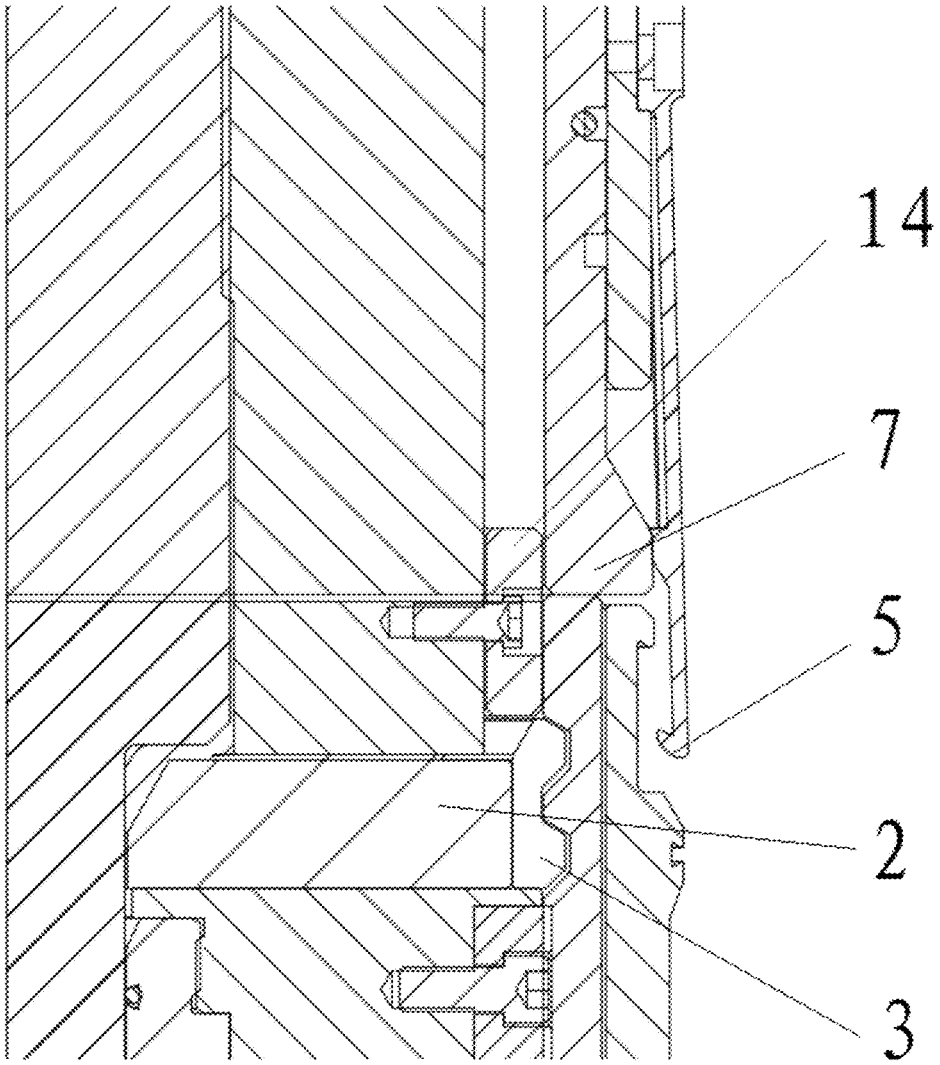
FIG. 7 is a sixth structural schematic diagram of tubing hanger recovery tool provided by the embodiment of the disclosure.

FIGS. 6 and 7 are partial enlarged views of the hook claw and the setting ring, in which FIG. 6 is a partial enlarged view when the hook claw is clamped with the setting ring, and FIG. 7 is a partial enlarged view when the hook claw and the setting ring are about to separate after the hook claw expands.

The device embodiments described above are only schematic, in which the units described as separate components may or may not be physically separated, and the components displayed as units may or may not be physical units, that is, they may be located in one place or distributed to multiple network units. Some or all of the modules can be selected according to actual needs to achieve the purpose of this embodiment. Ordinary technicians in this field can understand and implement it without creative labor.

From the description of the above embodiments, those skilled in the art can clearly understand that each embodiment can be realized by means of software and necessary general hardware platform, and of course it can also be realized by hardware. Based on this understanding, the essence of the above technical scheme or the part that has contributed to the prior art can be embodied in the form of a software product, which can be stored in a computer-readable storage medium, such as ROM/RAM, magnetic disk, optical disk, etc., and includes several instructions to make a computer device (which can be a personal computer, a server, or a network device, etc.) execute the methods of various embodiments or some parts of embodiments.

Finally, it should be explained that the above embodiments are only used to illustrate the technical scheme of the present disclosure, but not to limit it; Although the present disclosure has been described in detail with reference to the foregoing embodiments, those skilled in the art should understand that it is still possible to modify the technical solutions described in the foregoing embodiments, or to replace some technical features with equivalents; However, these modifications or substitutions do not make the essence of the corresponding technical solutions deviate from the spirit and scope of the technical solutions of various embodiments of the present disclosure.

What is claimed is:

1. A recovery method for a tubing hanger, configured for a tubing hanger recovery tool, wherein the tubing hanger recovery tool comprises: a mandrel, a locking part and a hook claw part;

a lower end face of the mandrel is in contact with an inner side of the locking part, and the mandrel squeezes the locking part when moving to the tubing hanger, and the locking part is locked with the tubing hanger after being squeezed;

both sides of a bottom end of the mandrel are inverted trapezoidal surfaces, the inner side of the locking part is a regular trapezoidal surface, and an inclined surface of the bottom end of the mandrel is in contact with an inclined surface of the locking part;

the locking part comprises a locking block and a locking ring;

the locking block has a right-angled trapezoidal structure, and an inclined waist of the locking block is in contact with the inclined surface of the bottom end of the mandrel;

a right-angled waist of the locking block is connected with the locking ring;

when the mandrel moves to the tubing hanger, the mandrel pushes the locking block and the locking ring, and the locking ring locks the tubing hanger;

the hook claw part surrounds the mandrel, and the mandrel drives the hook claw part to the tubing hanger when moving to the tubing hanger, and the hook claw part is clamped with a setting ring of the tubing hanger;

wherein the recovery method for the tubing hanger comprises:

moving the tubing hanger recovery tool directly above the tubing hanger;

moving the mandrel downwards for a first distance, the bottom end of the mandrel squeezes the locking part, and the locking part is locked with the tubing hanger, and the hook claw part is clamped with the setting ring of the tubing hanger;

moving the mandrel upwards for a second distance, and under a drive of the mandrel, the hook claw part moves upwards for the second distance together with the setting ring of the tubing hanger;

pulling the tubing hanger to move with the tubing hanger recovery tool to realize a recovery of the tubing hanger;

wherein before pulling the tubing hanger to move with the tubing hanger recovery tool, further comprising:

carrying out a safety detection, and if determining that the tubing hanger recovery tool is allowed to pull the tubing hanger, recovering the tubing hanger;

if determining that the tubing hanger recovery tool is not allowed to pull the tubing hanger, controlling the tubing hanger recovery tool to unlock the tubing hanger;

wherein the step of controlling the tubing hanger recovery tool to unlock the tubing hanger comprises:

moving the mandrel downwards for a third distance to unlock the hook claw part from the setting ring of the tubing hanger;

moving the mandrel upwards for a fourth distance to unlock the locking part from the tubing hanger;

wherein the step of moving the mandrel downwards for the third distance to unlock the hook claw part from the setting ring of the tubing hanger comprises:

moving the mandrel downwards for the third distance, wherein a bottom end of the hook claw part expands, and unlocking the hook claw part from the setting ring of the tubing hanger.

2. The recovery method for the tubing hanger according to claim 1, wherein the hook claw part comprises a hook claw connector and a plurality of hook claws, and the plurality of hook claws are clamped with the setting ring of the tubing hanger;

tops of the plurality of hook claws are connected with the hook claw connector, the plurality of hook claws surround the mandrel, and bottoms of the plurality of hook claws are barbs distributed inward.

3. The recovery method for the tubing hanger according to claim 2, wherein the hook claw part is connected with the mandrel through a piston part;

the piston part comprises an expansion ring, the expansion ring is arranged between the hook claw and the mandrel, and configured for pushing the hook claw to expand outwards to separate the hook claw from the setting ring of the tubing hanger.

4. The recovery method for the tubing hanger according to claim 3, wherein a bottom end of the expansion ring comprises a boss, and an inner side of the hook claw is provided with an expansion bulge, and the boss of the expansion ring pushes the hook claw to expand outwards by squeezing the expansion bulge.

* * * * *